US008062477B2

(12) United States Patent
Appleford et al.

(10) Patent No.: US 8,062,477 B2
(45) Date of Patent: Nov. 22, 2011

(54) PULP PRODUCTS

(75) Inventors: Mark Appleford, Hampton (AU); Stuart Gordon, Hampton (AU)

(73) Assignee: Varden Process Pty Ltd, Hampton, Victoria (AU)

( * ) Notice: Subject to any disclaimer, the term of this patent is extended or adjusted under 35 U.S.C. 154(b) by 383 days.

(21) Appl. No.: 12/301,412

(22) PCT Filed: Jun. 26, 2007

(86) PCT No.: PCT/AU2007/000883

§ 371 (c)(1),
(2), (4) Date: Nov. 18, 2008

(87) PCT Pub. No.: WO2008/000024

PCT Pub. Date: Jan. 3, 2008

(65) Prior Publication Data

US 2009/0229773 A1 Sep. 17, 2009

(30) Foreign Application Priority Data

Jun. 26, 2006 (AU) ..... 2006903417

(51) Int. Cl.
*D21J 3/00* (2006.01)
*D21J 3/10* (2006.01)
*D21J 7/00* (2006.01)

(52) U.S. Cl. ..... 162/218; 162/134; 162/221; 162/227; 162/230

(58) Field of Classification Search ..... 162/218, 162/220–224, 226–227, 230–231, 117, 134; 428/34.1–34.3, 35.2
See application file for complete search history.

(56) References Cited

U.S. PATENT DOCUMENTS

| | | | | |
|---|---|---|---|---|
| 2,704,493 | A | 3/1955 | Randall | |
| 3,075,872 | A * | 1/1963 | Reifers | 162/223 |
| 3,135,649 | A * | 6/1964 | Foote | 162/117 |
| 3,253,970 | A * | 5/1966 | Williams | 156/228 |
| 3,373,079 | A * | 3/1968 | Eastman et al. | 162/265 |
| 3,401,079 | A * | 9/1968 | Wells | 162/219 |
| 3,477,908 | A * | 11/1969 | Daniele | 162/392 |
| 4,088,259 | A | 5/1978 | Sutton | |
| 5,039,465 | A * | 8/1991 | Freeman et al. | 264/86 |
| 6,645,348 | B2 * | 11/2003 | Kumamoto et al. | 162/220 |
| 7,067,041 | B2 * | 6/2006 | Tsuura et al. | 162/218 |
| 2003/0150582 | A1 * | 8/2003 | Tsuura et al. | 162/218 |
| 2009/0229773 | A1 * | 9/2009 | Appleford et al. | 162/134 |

FOREIGN PATENT DOCUMENTS

| | | | |
|---|---|---|---|
| GB | 1091090 | A | 11/1967 |
| WO | WO 2008000024 | A1 * | 1/2008 |

OTHER PUBLICATIONS

Derwent Abstract Accession No. 2003-351117/33, KR 2003002782 A (Hwasung Ind Co Ltd) Jan. 9, 2003.

* cited by examiner

*Primary Examiner* — Jose A Fortuna
(74) *Attorney, Agent, or Firm* — Richard M. Goldberg

(57) ABSTRACT

A method of forming a moulded and printed product from pulp material including the steps of: forming a pre-form mould to have one or more planar surfaces, compound conjoined planar surfaces and/or two dimensional curved surfaces; transferring an amount of pulp slurry material to the pre-form mould; forming a moulded pre-form from the transferred pulp slurry material; applying printing to the planar and/or dimensional curved surfaces in a pre-distorted configuration; and moulding the printed pre-form to a different final shape whereby the printed surfaces retain the printing without running and the printing conforms to a desired post distortion configuration.

14 Claims, 4 Drawing Sheets

12

PULP PRODUCTS

CROSS-REFERENCE TO RELATED APPLICATIONS

The present application claims priority from Australian Provisional Patent Application No 2006903417 filed on 26 Jun. 2006, the content of which is incorporated herein by reference.

INTRODUCTION TO THE INVENTION

This invention relates to the packaging of consumer products and relates particularly to products that are formed of pulp material, particularly pulp material formed of waste paper, waste timber, waste fabric material, virgin timber and other similar pulp material. The invention more particularly relates to high quality products carrying high definition printing or other decoration.

BACKGROUND TO THE INVENTION

The creation of compelling and high quality packaging for consumer durables is well established and is executed in a variety of forms and formats known in the prior art but with each of the prior art, the formats and methodologies having their own particular limitations. The consumer market demands increasing colour, vibrancy and novelty in addition to sophistication in order to provide eye catching shapes that will serve to differentiate products available for sale in a given marketplace. An element of protection is also required for the goods in question and such protection requirements of the packaging in question, often require complex internal structures or substructures to protect the product in question which introduces, in some cases, considerable cost to the packaging products commonly available.

The core packaging functions, that is to contain, protect, preserve and promote the products in question, are often offset by substantial cost and lack of sustainability, that is the material is from a non-renewable source, or manufactured with a process that causes harmful environmental emissions, or in such a way as to preclude recycling and re-use. The cost of packaging can add considerably to the final cost of a product as it enters commerce and it is desirable to provide the best packaging possible at the most economical cost. Sustainability is also another key issue and becoming an increasingly politicised issue of keen interest in the minds of consumers who may consider the type of packaging used for a product as part of any "buying decision". In addition, there is a general move and sympathy towards the provision of legislation and guidelines against non-sustainable packaging of consumer products.

The commonly available packaging techniques and materials can be summarised as follows:

Paper and Cardboard

Paper or Cardboard packaging is the most common form of packaging found in the market today. Paper and cardboard packaging is low cost and has the ability to accept printing and finishing to a very high standard but has a principal restriction by limitation of its form. Card is printed and then folded so as to create boxes or constructions limited by largely planer configurations. The inability to readily conform cardboard to other than linear and planer shapes does not allow this material to be adapted for brand or product discrimination in the marketplace as all packaging based on cardboard incorporates substantial planer elements. The ubiquitous nature of cardboard also means that it is difficult for suppliers to create perceived value around the product without resorting to complicated treatments of the boxes, including lamination and use of metallic and plastic films etc. The more complicated the printing and laminating and/or folding involved in any manufacture of a packaging product, the more costly the end product results which must be passed onto the consumer. In addition, a number of the perceived high quality treatments in cardboard and paper packaging, require the use of processes that are not environmentally sustainable, or which hinder the recycling of the packaging and therefore make the packaging less environmentally friendly than it otherwise could be.

Use of recycled materials is also limited by a reduction in strength of cardboard; the main process used for packaging materials is the Fourdrinier process. This process creates a flat sheet of material where fibres are aligned in the direction of the production flow, giving rise to distinct properties within the finished board, which can be used to either increase the compression strength of the board or its flexibility. These particular features are compromised by the use of recycled pulp because of the changes occurring in the pulp particles during recycling processes. In addition, legislation governs the application and use of recycled materials in this process due to hygiene issues.

Plastic is a highly creative medium allowing for the development, design and creation of packaging shapes that are unique, individual and include curves, compound curving or organic forms and which may in turn produce an enormous range and configuration of packaging and presentations, thereby allowing the branding of a particular product or the shape of the actual container to be used as powerful marketing and branding tools. Plastics are able to be brightly coloured and have the ability to take up print and decoration across compound surfaces to give a similar result to that of moulded metal but at a much lower cost. Plastics can be decorated by a number of means; direct printed, labelled or in-mould labelled. This latter process involves the insertion of a polymer label into the empty plastic forming-mould, the label is robotically placed and as it is a planar printed label is positioned on a planar section of the tool. The plastic material is introduced and the surface of the plastic product fuses with the label material to create a smooth decorated surface. This technique of "in mould labelling" is well known and creates interesting and unique packages for use with a variety of goods.

A key limitation and drawback with plastic packaging is the non-sustainability of this packaging methodology and an increasingly poor consumer perception of the throwaway and disposable nature of plastic packaging. Most thermo-plastics are derived from oil and as such the price of this commodity is invariably increasing, in addition to the perception of the non-renewable nature of this commodity, it suffers a generally poor public perception. Most thermo plastics are readily recycled, although the variety of plastics complicates the sorting process. The recycled material is classed as re-grind material and as such its use is more limited than virgin material. This is most notable in the products that have direct food contact were the use of regrind material is not permitted or in some cases it has to be the external material, tied to the inner which is virgin plastic.

An increasing use of organically-derived plastics to address some of the environmental concerns are provided for in the prior art, however, organically-derived materials can also have problems, in particular the so called "bio-polymers", which may not be as sustainable as they first appear. Most first generation bio-polymers are derived from polylactic acid and this material is not catered to in the current plastic recycling methodologies. In addition, polylactic acid is not compatible with petroleum based plastics and is generally considered a contaminant. In addition, the current rationale understood with respect to bio-polymers is that they are compostible and so can be added to landfill. However the energy required in their creation is not returned or reduced by this process and in a number of cases, polylactic acid is inferior and/or requires more material to equal the performance of petroleum based plastics.

Glass

Clarity, strength and substance as well as premium perception has kept glass a first choice material for a number of high end products including perfumes, skin care products etc where the weight of the glass and its inherent coolness serves to enhance the perception of quality. However glass as a packaging medium, is heavy, fragile and requires a lot of energy to melt and reform.

Metal

Pressed metal boxes and tins are often used in consumer packaging because they can be brightly coloured and formed into a number of eye catching shapes, including curved and organic shapes.

Metal can be formed either by welding into cylinders or through impact moulding. Impact moulding involves the use of a flat sheet of metal which is formed between two shaped metal dyes which subject the metal to a high impact and forces the flat sheeted material to conform to the profile of the dye.

The deformation of metal during this process, whilst it can be severe, generally with respect to the artwork applied to metallic boxes and tins, deformation is of little concern and the artwork can be readily applied to the flat sheet of material in a pre-distorted form which then goes through the moulding process and deforms with the metal such that the requisite imagery or graphics are rendered onto the final product Metal itself is however an expensive raw material and in comparison to paper, the unit cost of a metallic container is far greater than the similar piece of packaging made from plastic or cardboard. The use of metallic boxes and packaging is generally less sustainable than the previously described materials and requires substantial energy for recycling. In addition, the use of metallic materials for packaging involves the use of a finite resource and the mining industry and forging of metals for packaging is increasingly being perceived by the consuming public as environmentally questionable.

Pulp Fibre

Formed pulp paper has a restricted and limited public perception at this point in time due to its principal association with low end single colour products like fruit trays or egg boxes. The fibre used in the preparation of pulping products can be the same which is used in typical paper production but its also possible to use fibres derived from products other than wood. The development of pulp fibre processing in its simplest form involves a creation of a mat of fibres by lifting a mesh through a vat of fibres in suspension. The fibres are then collected by the mesh and excess water drains away. The positively shaped mesh is then brought into contact with the negatively shaped mould and subsequently heated with the application of pressure to remove excess water. The process then dries the mat into its final form. The currently used processes generally give pulp a distinctive coarse finish with the marks of the mesh clearly visible as witnesses on one or more of the faces.

Modern high pressure pulp thermoforming has provided many improvements to the previously described single stage process. Modern high pressure pulp thermoforming generally involves a two stage forming process which can result in high quality finished products with a smooth finish which is comparable to that of high quality flat cardboard. The modern two stage pulp thermoformer works in such a way that the pulp is moulded over the extraction mesh then transferred to a conventional solid male-female mould with extraction vents. The mould is then heated to about 200° and steam extracted through vents in the mould by vacuum which results in a dense, smooth finish product that can be curved or contain multiple compound curves.

The benefits of pulp as a packaging medium include low cost and the ability to conform the product into a wide variety of highly complex compound shapes. The added benefit of pulp as a packaging medium include the ability for the product to be coloured right through with the use of dyes in the pulp vat. In addition, the material can have variable wall thickness depending on the specific localised pressure used at the point of forming which gives excellent insulation properties for heat and shock.

The key disadvantage of pulp fibre packaging from a commercial point of view is the limitation to the use of a single colour throughout the packaging material. In addition, once the pulping material has been formed and dried into the final moulded shape, it is not possible to economically print upon or decorate such surfaces.

Whilst it is possible to place adhesive stickers on such packaging, adhesive stickers are only able to be applied economically to planer surfaces which provide distinct limitations to the form and design of such packaging products. In addition, adhesive stickers are not visually appealing because they are not fully integrated with the design and manufacture of the product and the application of adhesive labels requires precision and specific care in alignment and places limitations on any high speed industrial process. A further technique for use with pulp fibre packaging includes the use of vacuum or heat to form a laminated plastic film over the finished dried packaging product complete with compound curves. However, such films have disadvantages including their appearance as add-ons or additions and distraction from the integrated perception of the whole design; such products are also limited by the compound nature of the surface to which they can adhere where extremely deep valleys or ridges are not possible without the film ripping or folding which compromises the final product; and finally, the nature of the adhered film is such that it is necessarily a plastic adhered to paper pulp which then compromises recycling and sustainability.

It would be desirable to provide an alternative to current packaging processes and techniques utilising the advantages of pulp fibre providing such packaging can be provided with a high finished quality and with the ability to receive high definition printing and decoration as found in the previously detailed prior art products.

Accordingly, one object of the invention is to provide an improved method of moulding and printing pulp fibre materials.

For the purposes of this specification, the term "pulp material" shall be taken to mean pulp formed of a mixture of cellulose fibres, including, but not limited to, cellulose fibres derived from waste and other paper, cardboard, yarns and textiles, plant fibres including wood chips and other timber and plant material including waste, and any other material predominately of cellulose.

Moulded pulp products are well known, particularly as both internal and external packaging products. For example, moulded pulp egg crates, or cartons have been used for decades for packaging eggs. Similar packaging products are used for a variety of fruit and vegetables and other products that require protection during transportation. Computer components, printer cartridges, vehicle components and many other products are packaged using moulded pulp packaging. Moulded pulp is used for containers for plants in plant nurseries.

The pulp for such packaging is conveniently and cheaply manufactured from waste paper and other waste material. In one process, a pulp slurry is prepared from waste paper, cardboard, textiles and other similar waste material. The slurry may include additives of any type, including, but not limited to, chalk and fabric material. Such additives impart desirable characteristics to the finished product. For example, chalk added to the pulp slurry results in a product having a china-like feel, while the addition of fabric to the slurry results in a product having a quality fabric feel.

In producing a product of moulded pulp, a mould is prepared for the product to be made. A mat of pulp is lifted from the slurry container, generally using a framed mesh, and is deposited into the preliminary mould. The thickness of the pulp mat is determined by the relative speed of the framed mesh dip into the slurry container, and subject to the fibre and moisture content of the pulp slurry. The mat is placed into the mould and pressure or heat and pressure is applied to remove the water content and force the pulp and mat to adopt the shape of the mould.

With products of this type, printing or other decoration may be applied only to any planar surfaces or surfaces that contain only two dimensional curves, such as cylindrical or conical surfaces or the like.

It is therefore desirable to provide an improved product manufactured from pulp material, particularly waste paper pulp, virgin paper pulp and pulp made from other waste materials, having a decorative and/or pleasing appearance.

It is also desirable to provide a product manufactured from pulp material which has a high quality printed surface.

It is also desirable to provide a pulp product having multiple complex shapes and which contain printed material.

It is also desirable to provide a method of manufacturing a moulded pulp product having printing or decoration applied thereto during the manufacturing process.

Statements of the Invention

According to one aspect of the invention there is provided A method of forming a moulded and printed product from pulp material comprising the steps of:

forming a pre-form mould to have one or more planer surfaces, compound conjoined planar surfaces and/or two dimensional curved surfaces;

transferring an amount of pulp slurry material to said pre-form mould;

forming a moulded pre-form from said transferred pulp slurry material;

applying printing to said planar and/or dimensional curved surfaces in a pre-distorted configuration; and moulding the printed pre-form to a different final shape whereby said printed surfaces retain said printing without running and said printing conforms to a desired post distortion configuration.

With this aspect of the invention, and in accordance with preferred embodiments of the invention, the conventional moulding process is divided preferably into two parts, where the pulp is moulded and formed twice, in two separate and different moulds. A preliminary mould is prepared for the product to be made. The preliminary mould is designed to be within predetermined tolerances, shapes and dimensions of the final mould shape as there is a limited elasticity in a preliminary moulded pulp pre-form for the subsequent moulding stage.

A mat of pulp is lifted from the slurry container, preferably by a framed mesh, which is itself shaped to be the opposing part of the preliminary mould and is offered up into the preliminary mould. The thickness of the pulp mat is determined by the relative speed of the framed mesh dip into the slurry container, and subject to the fibre type, consistency of the slurry and moisture content of the pulp slurry.

The mat is formed into a pre-form shape in the preliminary mould by applying heat and pressure. A vacuum is applied to the rear of the mesh to facilitate the extraction of water content form the pulp in the form of steam. This process sets the overall material parameters of the pulp and the initial characteristics of the product shape. These characteristics include the volume of pulp in the product, uniformity of wall thickness, initial density and dimensional size. These characteristics are calculated to allow for specific tolerances in specific areas, such that those areas that will be subjected to deformation in the secondary moulding process are left with higher moisture contents and lower particle density, so that the pulp retains elasticity at this point. During this stage of the moulding process, an amount of the moisture content of the pulp slurry is removed from the mat. When the pre-form has been formed by and to the desired shape by the preliminary mould, preferably using pressure or heat and pressure, the pre-form is removed therefrom and transferred to a final mould which will impart the final product shape to the pre-form. The final shape may involve the provision of ribs, areas of different thicknesses, areas of different densities, complex curved shapes, planar surfaces and many other different features. The development of such features may be the function of differing heat and pressure applications, and over varying times, calculated to give the desired characteristics for the moulded pulp product. Accordingly, levels of rigidity, dryness, insulation, barrier properties and other properties may vary within a product and between products.

Thus, for any given product design, the pre-form and final form moulds will involve designing the moulds to apply different amounts of heat and pressure in different locations to create areas of differing shapes, thicknesses and densities in walls, differing rib and fin densities, and other product shape characteristics in order, for example, to retain or disburse heat (as an insulator) or physical shock, as required by the end product.

Preferably, the moulded product is formed in two stages as outlined above, and the printing is applied to the pulp after the first moulding process, but before the second moulding process by a printing process. The printing is designed so that, during the final moulding process, the printed material, when conformed to the final complex moulded shape, presents an image which may be easily identified, read and understood, or scanned. Decoration, in the form of embossing, raised or depressed areas which accentuate or complement the printing may occur either in the preliminary or secondary moulding, in both, or progressively, that is the same areas partially raised or depressed in the preliminary moulding are then further depressed or raised in the secondary moulding. Thus, the printing and decorating that occurs on the pre-form prior to forming the final shape is formed into identifiable indicia, logos, recognisable printing or recognisable decoration when the pre-form is subsequently processed in the final mould to its final shape.

Products of some embodiments of the invention may take the form of a complex shape, such as a food container in the shape of an animal head, such as the head of a monkey. With such a product, the pre-form may be in the shape of two connected parts of a polyhedral having multiple planar surfaces each of which can be easily printed with a decoration or design. During final moulding, the printed polyhedral halves are formed into the lower and upper head shapes of multiple, complex curves in the shape of, for example, a monkey's head, and the printed surfaces take the shape, form and appearance of the facial features of the monkey's head, including eyes, nose and ears. The edges of each container half are designed to meet and are shaped and printed in the form of the mouth. Such a novel container may have many uses in the food industry, such as a container for takeaway food products, confectionery, or the like; or as packaging for a wide variety of personal care goods such as perfume and toiletries.

Products made in accordance with embodiments of the present invention may take any shape or form that is able to be moulded using pulp moulding techniques. Thus, high quality moulded pulp products with sophisticated printing and decoration may be produced relatively cheaply to replace products of other relatively expensive materials such as synthetic plastics.

In preferred embodiments of the invention, the design of the print or decoration to be applied to the two dimensional surfaces of the pre-form is developed so that, when the surfaces are moulded to complex curves, the printing and/or decoration takes up a desired appearance, which may be in the form of printed letters, pictures, logos or other indicia. The printing is therefore designed to be developed, on moulding from a planar to a curved shape, to the required finished appearance of lettering or the like, including barcodes or other product identification information. During the moulding process, the printed material on the planar or two dimensional curved surfaces morphs or transmutes into the shapes and appearance on the complex curved shapes on the moulded surfaces to display the desired finished appearance. Thus, the printing may expand or contract with the change in the shape of the surface on which it is printed.

Preferably, the inks or other fluid, or powder, that is used for the printing are selected from inks, powders or fluids having the necessary elasticity, colour depth, high drawing and opaqueness to be able to deform, during moulding, without colour change, separation and undesired intensity variation. The ink or other coating compound must also be able to withstand the pressures and heat used during the secondary moulding stage. The processes of preferred embodiments of the invention, however, are particularly relevant to designs with lettering, barcodes, logos and the like on the finished moulded product. This may use an anamorphic projection to modify the aspect ratio of the finished graphic design by optical distortion to stretch or compress the image in various dimensions so that the design is faithfully reproduced in the finished form from a distorted initial image printed on the two dimensional surfaces. A computer assisted design program may be used to transfer the design directly or through the more traditional reprographic methods onto a carrier film, into an automated printing machine or print spray machine as required by the end product design. An optimum target point of decoration on the pre-form is identified, using a deformation grid to ensure that the anamorphic distortion is able to be distorted to a predictable extent during final moulding.

The surfaces of the pre-form to which printing is to be applied, which surfaces may be planar or curved in one direction, such as part cylindrical or conical surfaces, can have the printing applied thereto by one or more of many known printing processes. For example, the printing step or steps may be performed using offset letterpress printing, in which the shaped pre-form is supported by a mandrel or the like, which may also serve as the male element of the pre-form mould. A dry offset letterpress process may combine desired colours onto a single transfer printing head which then applies the "wet" ink in a single pass.

In other embodiments, an "in-mould" process may be used whereby a pre-printed piece of carrier film is inserted into the pre-form mould and the print thereon is then transferred to the pulp pre-form by heat, pressure or adhesive. The carrier material of the film can then be removed from the mould or from the moulded pre-form at the end of the moulding cycle. The carrier film can also be used to laminate the exterior of the pulp pre-form, if desired. The pre-printed film may be fully registered within the mould by means of lugs or other registration processes to ensure that the printed material is properly and accurately applied to the pre-form during the print transfer process. The direct transfer cylinders, labels or the print transfer film may be printed with a combination of specific single colours, which could either be referenced directly to a commercial colour palette (such as pantone), or be a specific mix based on a non-palette hue, or in any of the full colour process techniques (cmyk/hexachrome) to create an accurate representation of photographic/illustrative/graphic elements/indicia/text and data related devices (barcodes/RFID etc). Special effect inks, finishes and beneficial coatings can also be applied at this time, these are able to increase some of the physical or visual aspects of the product. This can include, but is not limited to, increasing resistance to scuffing, delivering anti-counterfeiting, magnetic or UV inks to allow for increased product security, sealing varnishes to prevent or resist contamination of the pulp substrate by biological or chemical elements (anti-fungal etc), reactive coatings which can highlight, by physical change (typically colour change) additional information to pack users, such as product contamination, product temperature, freshness levels etc.

A further process which may be used with embodiments of the invention include a pad printing process which involves applying the decoration to a semi-malleable, or resilient pad which is then engaged with surfaces of the pre-form. The image may be transferred to the pad from a printing plate, and the semi-malleable pad is able to transfer the image to the pre-fomm even when some surfaces of the pre-form are uneven or have small curves to which the semi-malleable pad is able to conform.

Screen printing processes may also be used to print images onto the surfaces of the pre-form. The screen printing process may be beneficial when it is needed to apply high build inks or when applying other surface treatments to the pre-form. Such other surface treatments may include specific coatings to improve the barrier properties of the material, tactile coatings to improve grip or create Braille dots, amongst others.

Combinations of the printing processes referred to above, or other known printing processes may also be adapted for use in performance of embodiments of the present invention.

DETAILED DESCRIPTION OF INVENTION

In order that the invention is more readily understood, embodiments thereof will now be described with reference to the accompanying drawings wherein.

Figure 1:
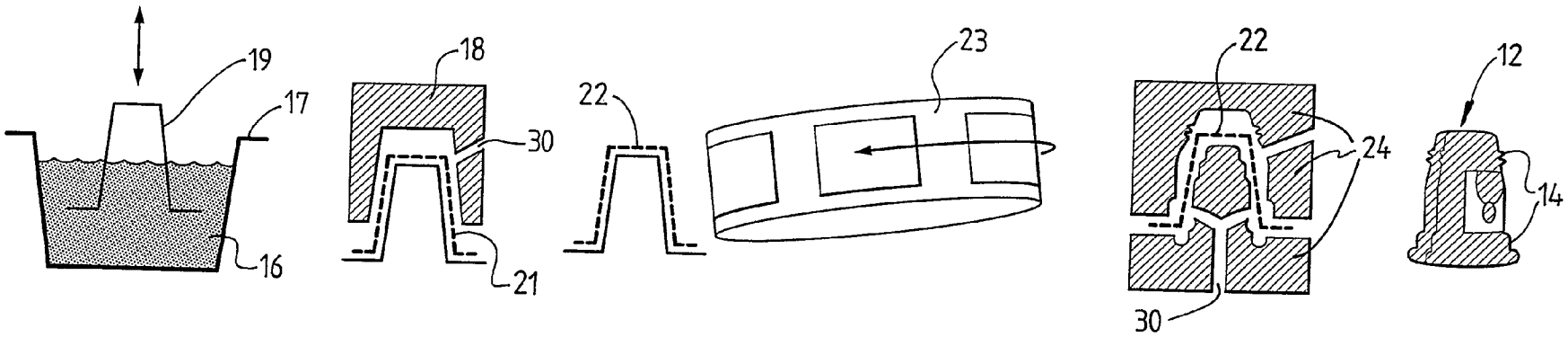
FIG. 1 is a schematic illustration of one embodiment of the process of forming a moulded pulp product.

Referring to FIG. 1, a product 12 moulded from pulp material is in the form of a cup having a complex outer surface shape with a plurality of ribs 14 which may be of different thicknesses and spacings to provide insulation, crush-resistance and other characteristics to the cup product 12.

A slurry 16 of pulp material as hereinbefore defined is mixed in a container 17, and the desired additives to produce desired end-product characteristics are added to the slurry 16. Such additives may include chalk, fabric material, and the like known in the art of pulp moulding. The fibre content and moisture levels of the pulp slurry 16 are controlled so as to obtain maximum control over the deform characteristics of the pulp during the moulding processes and to thereby obtain control of the deformation profile and retention of the subsequently applied decoration or other printed material. Preferably, the moisture level of the slurry 16 in the container 17 is between 100% and 600% by weight (total weight/dry weight), more preferably between 200% and 450%, and, in some embodiments, between 300% and 400% by weight. It will be understood that the moisture content will depend to a large extent on the nature of the fibres in the slurry.

A preliminary, or pre-form mould 18 is prepared so as to have planar and/or two dimensional curved surfaces, such as cylindrical or conical surfaces, to which printing or other coatings may be easily applied. In the illustrated embodiment, the pre-form mould 18 has a substantially conical form, to produce a pre-form with a conical outer surface 20. A framed mesh 19, which is in the form of the preliminary mould is dipped into the slurry 16 and lifts out a mat 21 of the pulp material from the slurry 16 in the container 17. The mat 21 is offered up to the matching part of the preliminary mould by the shaped mesh platen 19 where it is formed into the pre-form 22 using, air pressure, heat or other moulding processes which set the overall material parameters of the pulp product and the initial characteristics of the product shape. These characteristics include the volume of pulp material in the product, the uniformity of wall thickness, initial density and product size. The pre-form mould also removes a proportion of the liquid from the pulp mat 21 by applying a highly controlled amount of heat and pressure, and extracting steam through the mesh and through special vents 30 built into the opposing part of the preliminary mould (note, typically these vents are placed so as not to align with print areas as they cause a change in surface texture which interferes with the printing process) so that the pre-form is able to receive printed material thereon.

When the pre-form 22 is released from the mould 18, it is not self-supporting because there is still a high moisture content within the pulp, to allow deformation at the final stage. It is held onto the preliminary mould by suction. At this point it has the shape of a hollow, frustroconical container matching the shape of the pre-form mould 18. The outer, conical surface 20 of the pre-form 22 is then able to be printed with appropriate printing and/or decoration using, for example, a dry, offset letterpress printing process schematically indicated at 23, or using offset photolithography, or other printing processes.

The image printed onto the two dimensional conical surface of the pre-form 22 is an anamorphic projection which is designed so that, when the final product 12 is moulded, the printed indicia takes the desired form and shape required for the finished product. To create an accurate model for the distortion profile there are two distinct methods, the first is to utilise a printed grid with either uniform or otherwise predetermined pattern. A typical grid would use either an XY format or concentric circle. The product to be manufactured is then printed with the grid and the process of shaping and distorting is completed to create a finished product. The grid on the finished product will typically be distorted and mapping the final co-ordinates of this grid against the pre-deformed co-ordinates allows the creation of a distortion map. The other method is based on profiling the material to ascertain its deformation characteristics. This data would then be used to create a virtual distortion map which would then enable specific computer aided design software to predict the final level of distortion across any given shape. The mapping of the distortion across the surface, real or virtual, then enables the accurate pre-distortion of the original image/insignia/type/device so that it, the design, is faithfully reproduced in the finished form from the projection printed on the two dimensional surfaces. This form and shape may include the reproduction of lettering, barcodes, logos, images or any other design or decoration to be identified on the outer surface of the finished product 12.

The printed pre-form 22 is then transferred to the final mould 24 where it is subjected to heat and/or pressure to cause the pre-form 22 to conform to the shape of the final mould 24. This shape includes the ribs 14 on the finished product 12, which ribs 14 have complex shapes. The transformation of the printing on the two dimensional surface of pre-form 22 to the three dimensional shapes formed in the final product 12 require the inks used during the printing process to be able to be deformed, stretched, compressed or otherwise transmuted to the desired form on the finished product 12.

Figure 2:
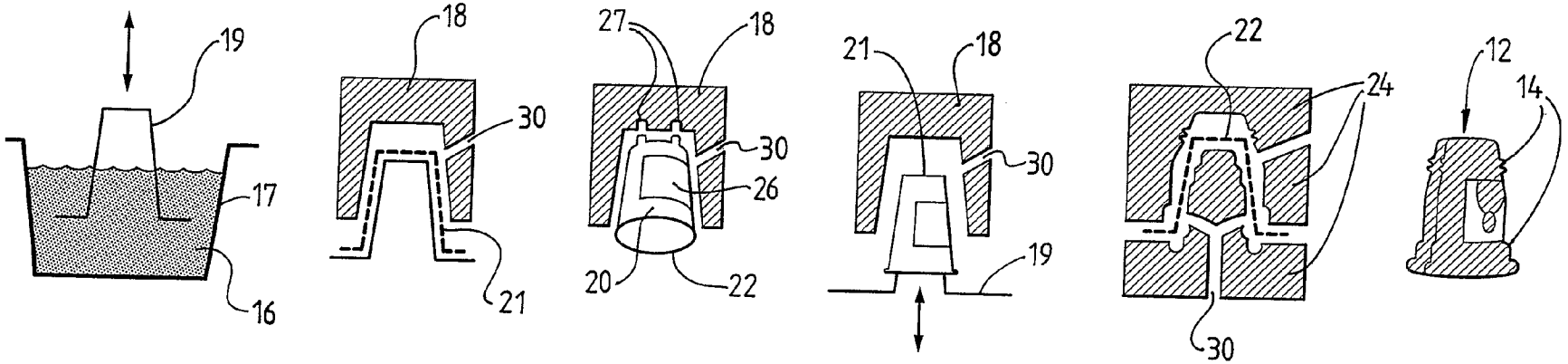
FIG. 2 is a schematic illustration of another embodiment of the invention.

Referring to FIG. 2, this embodiment is similar to that of FIG. 1 except that there are two separate preliminary mould processes before the final moulding. The first is where the shaped mesh platen lifts the pulp mat into the preliminary mould and a low heat (approx 50 degrees Celsius) and pressure is applied to create a loosely tamped version of the pre-form 22. As the pre-form mould opens, the pre-form is held onto the mould by suction, to give adequate support for the ensuing printing process. Then the indicia is applied to the pre-form 22 comprising a pre-printed label or film 26 which is applied to the pre-form. Appropriate tabs, or lugs 27 or other means, may be used to orient the label in the desired position within the pre-form mould 18. The pre-form mould then closes again, and heat and pressure are applied, under close parameters. The key here is to melt the heat release coating on the film, such that the ink is able to transfer to the wet pulp, and also to apply adequate pressure for the ink to bind and adhere to the pulp, whilst retaining enough moisture content within the pulp to allow for deformation inside the final moulding process. In one particular embodiment a temperature of 175 degrees Celsius, for one second combined with a pressure of 400 Kpa is sufficient.

This process is the optimum one for this embodiment of the invention, because it allows for a fast-moving automated process. When the product is relatively flat, the film may be advanced over the pre-form 22 whilst being held on an opposing pair of rollers. As the process proceeds then each section of used film is advanced from one spool or roller onto the opposing spool or roller. In some cases, where the finished article has a deep recess, and it is not practical to lay the print film over the product, then the film is cut into pieces and positioned in the pre-form mould 18, thereafter the rest of the process remains the same.

Figure 3:
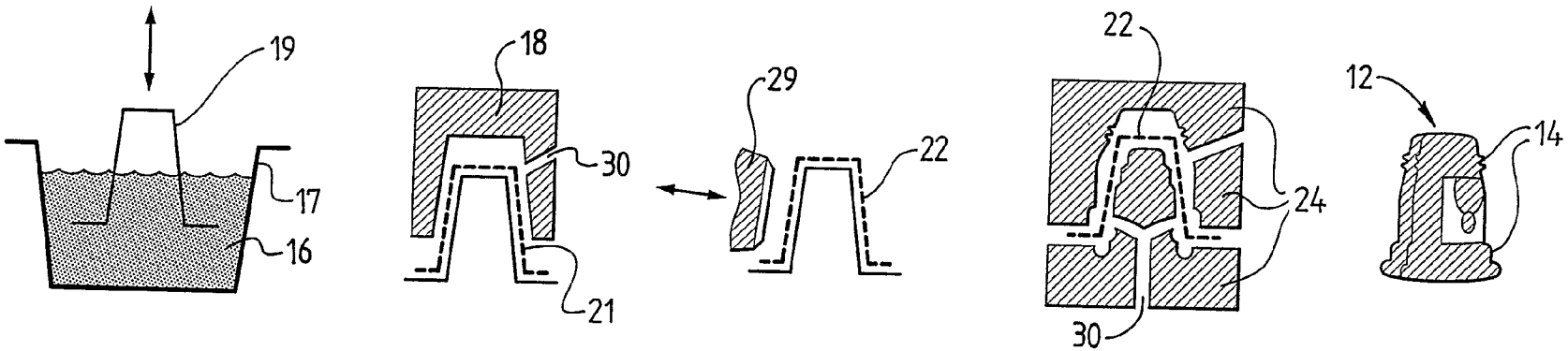
FIG. 3 is a schematic illustration of a further embodiment of the invention.

The label carrier film may either act as a laminate on the pre-form surface where it actually adheres to the surface, or may be ejected from the pre-form mould 18 on completion of the pre-form moulding process. The pre-form 22 is then transferred to the final mould 24 where the final product 12 is produced, with the shapes, texts and designs on the printed material transmuting to the desired appearance on the finished product 12. A higher heat is applied, typically 200 degrees Celsius, and all moisture extracted from the pulp by means of steam extraction vents, which are all placed on the opposing face of the pulp to the printed face.

Where in-mould and release film methods are used in the invention, a stable film is used, such as a Garfilm ERC film (trademark), onto which is applied a Heat Release coating, typically at a coverage in the region of 2.7 gsm film weight. Then a specific high-draw ink is used to print on the images or text, using a system with an engraved gravure cylinder with a line screen ranging between 110 and 200 lines per inch. The ink contains the usual additives to increase scuff resistance and adhesion, flexibility and specifically draw (which is required because of the distortion during the re-form process). Heat is then applied to the rear of the film so that the release coating forms a film with the ink, partially bonding with it, which further increases the adhesion and transfer to the pulp. At this stage the printed film is stable and can be transported or stored if required. Once ready for use the film is used either in pre-cut pieces or direct from a roll. As the product emerges from the preliminary mould, it is retained on the male component of the mould by suction applied through the vents in the mould designed for this purpose, and for the purpose of steam extraction. The film is placed onto the planar surfaces designed to receive it. Then the female mould is re-applied and heat applied, typically 150 degrees Celsius, for one second combined with a pressure of 400 Kpa. Referring to FIG. 3, in this embodiment, the printed design is applied to the conical outer surface of the pre-form 22 by a resilient pad 29, such as that known as a Tampo (trade mark) pad or similar, which is sufficiently malleable to facilitate printing onto uneven surfaces. Pad Printing is a relative of gravure printing. The inked image is created on an etched flat plate (cliché) in a manner similar to gravure (in the surface rather than proud or in relief as in letterpress or flexographic printing). A large, resilient silicone rubber pillow (the pad) is pressed against the cliché. The ink pattern is transferred to the pad, which is subsequently pressed against the substrate (in this case the pulp pre-form). Process (4 colour) printing can be accomplished by using several printing stations in sequence. The key feature of pad printing is the ability to print highly irregular surfaces. The resilient pad transferring the ink can conform intimately to surprisingly asymmetric and uneven surfaces. The resilient transfer pad lifts the image from the plate (cliché) etched with the decorative image prior to engaging the pad with the outer surface 20 of the pre-form 22. The printed pre-form 22 is then moulded to the final product 12 as previously described.

Figure 4:
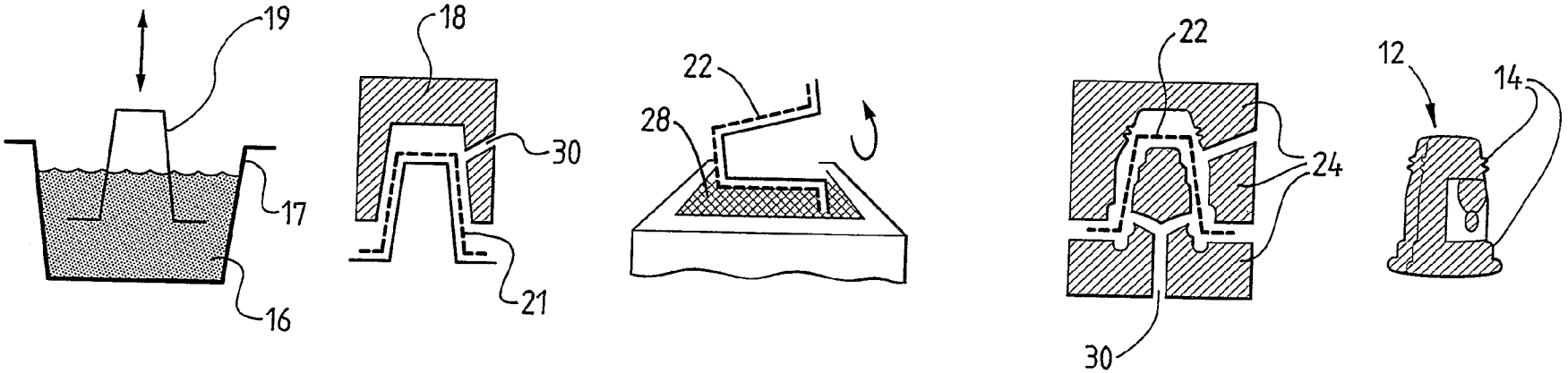
FIG. 4 is a schematic illustration of a still further embodiment of the invention.

FIG. 4 illustrates an embodiment wherein the pre-form 22 is printed using a screen printing technique. The screen mesh 28 is contacted by the surface of the pre-form 22 and the print is applied from the screen to the pre-form surface. The screen mesh 28 may be rotated around the axis of the pre-form 22 or the pre-form may be rotated and rolled along the planar surface of the screen mesh 28. Many forms of screen printing are known and may be adapted for use in embodiments of the present invention.

Figure 5:
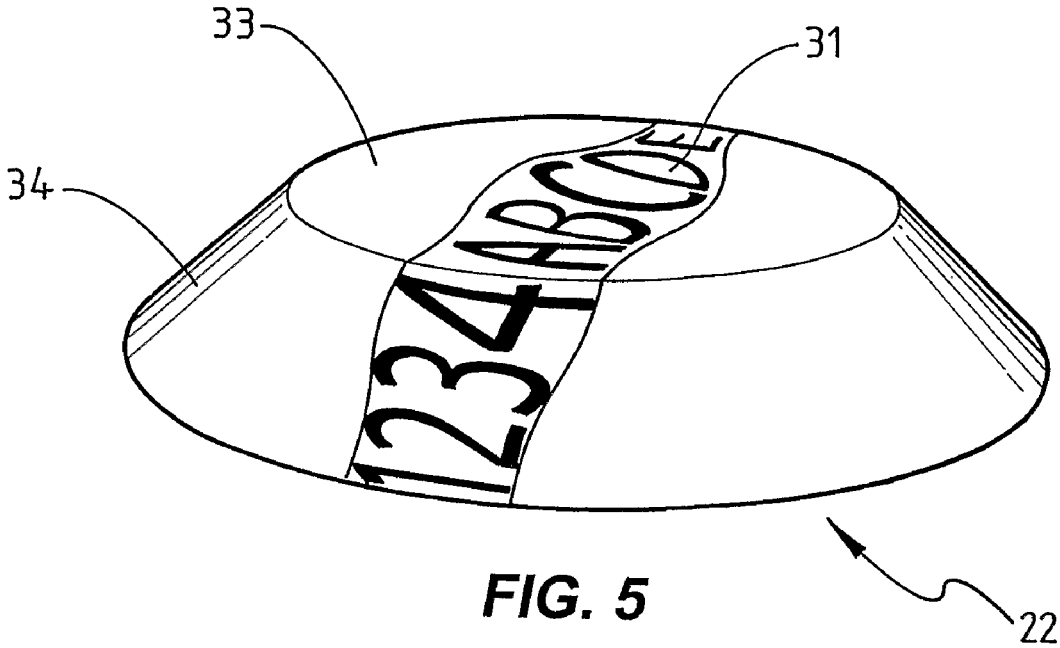
FIG. 5 is a perspective view of a printed pre-form of one embodiment of a product moulded from pulp material in accordance with an embodiment of the invention.
Figure 6:
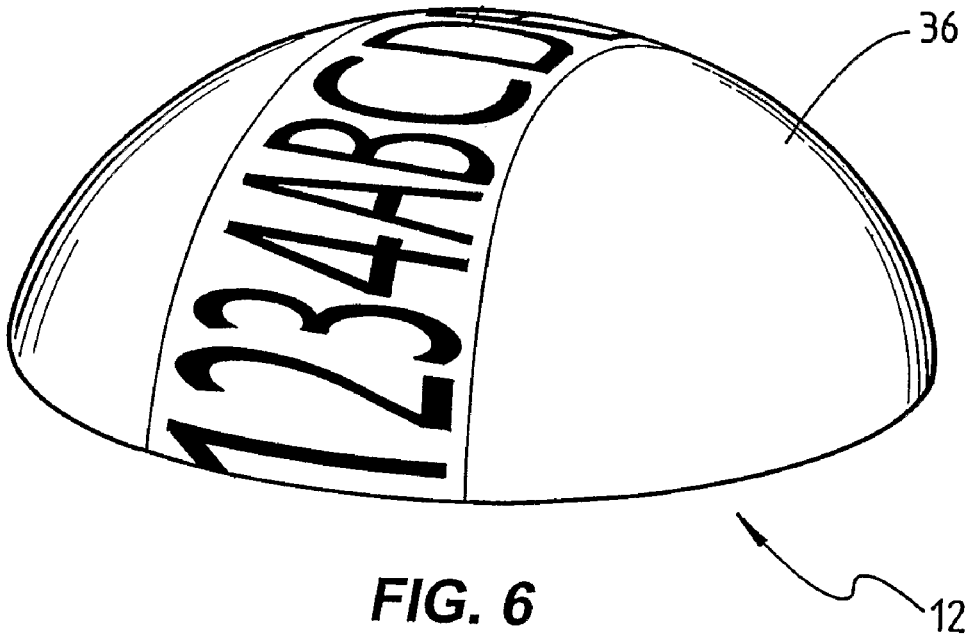
FIG. 6 is a perspective view of the final moulded product of FIG. 5.
Figure 7:
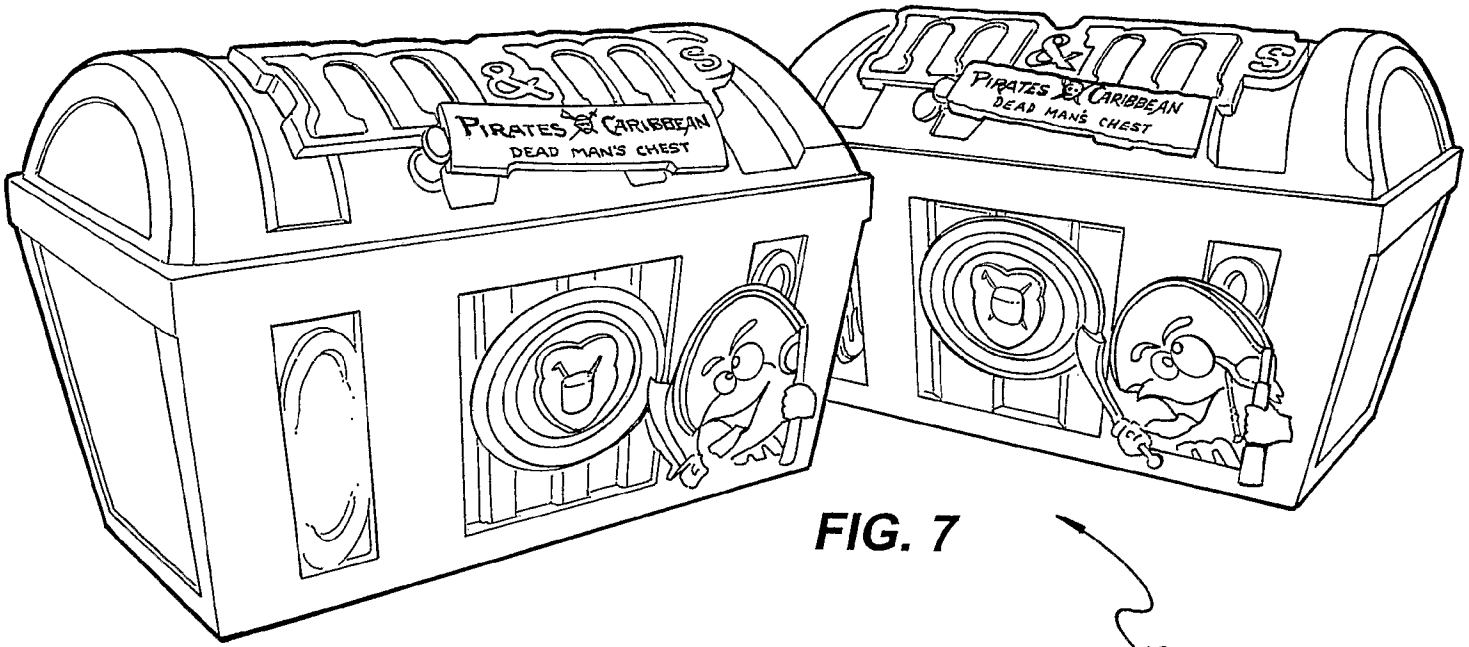
FIG. 7 shows the detailed packaging available from the invention when applied to a popular confectionery product.
Figure 8:
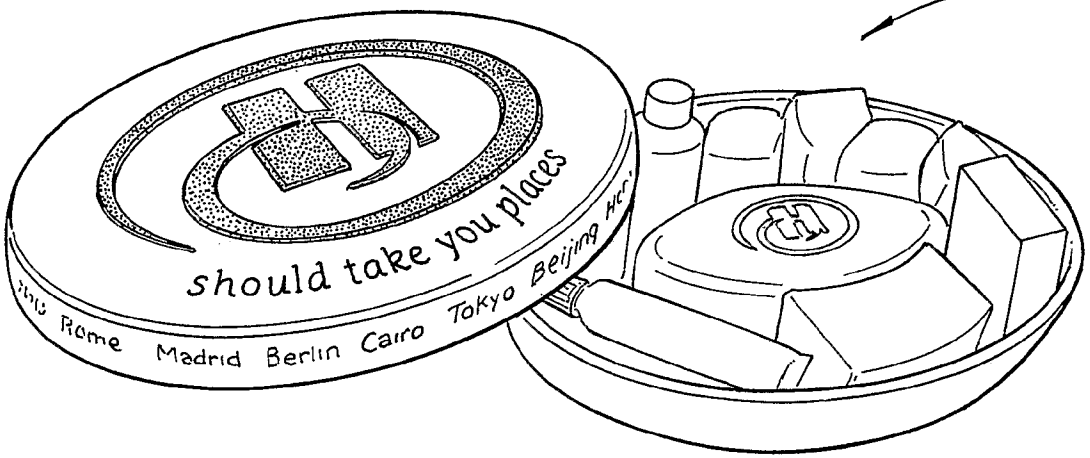
FIG. 8 shows another example of the invention.

As shown in FIGS. 5 and 6, a product 12, having a complex outer surface shape moulded from pulp material, in this case, a hemispherical bowl, can be printed or decorated in such a manner that decorative material in the form of letters, codes, logos or the like printed as an anamorphic projection 31 on the conical side surface 34 and planar top surface 33 of the pre-form 22 is recognisable and identifiable when the pre-form 22 is re-shaped to exhibit the complex curved surface 36. In the embodiment illustrated, the lettering 31 as an anamorphic projection is able to be printed by simple printing techniques on the flat top surface 33 and two dimensional side surface 34. The final moulding process causes the printed material to change shape to exhibit the desired properties.

Embodiments of the invention thus facilitate the manufacture of a multitude of moulded products using pulp material, the moulded products having complex shapes which, nonetheless, are able to be printed or decorated to produce attractive, aesthetically pleasing and/or informative products.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A method of forming a moulded and printed product from pulp material comprising the steps of:

forming a pre-form mould to have at least one of the following:
- planar surfaces,
- compound conjoined planar surfaces and
- two dimensional curved surfaces;

transferring an amount of pulp slurry material to said pre-form mould;

forming a moulded pre-form from said transferred pulp slurry material, said moulded pre-form having at least one of the following:
- planar surfaces,
- compound conjoined planar surfaces and
- two dimensional curved surfaces;

applying printing to said at least one of said planar and dimensional curved surfaces of said pre-form in a pre-distorted configuration, said step of applying printing using at least one of the following:
- letter press printing,
- in-mould printing where a pre-printed piece of film or label is inserted into said pre-form mould which is then transferred to said pulp pre-form by at least one of heat, pressure and adhesive,
- therimage heat transfer,
- pad printing and
- screen printing; and one of moulding and re-moulding the printed pre-form to a final shape whereby said printed surfaces retain said printing without running and said printing conforms to a desired post distortion configuration.

2. A method according to claim 1, wherein said run-free printing includes the use of ink adapted for run-free application to said pre-form mould and adapted for steam release.

3. A method according to claim 2, wherein said ink is selected from any one of a range of inks with at least one of the following properties:
- the ability to transfer at a specific heat range,
- the ability to not transfer again after an initial transfer,
- the ability to be stable at another heat range, food grade, light stable, stable under pressure, and solvent free, and formulated using solvents that allow for recycling.

4. A method according to claim 1, wherein said pulp slurry has a moisture level between 100% and 600% by weight.

5. A method according to claim 4, wherein said pulp slurry has a moisture level between 200% and 450% by weight.

6. A method according to claim 5, wherein said pulp slurry has a moisture level between 300% and 400% by weight.

7. A method according to claim 1, wherein said in-mould printing includes the use of a polyethylene terephthalate (PET) film onto which is applied a heat release covering at about 2.7 gsm film weight.

8. A method according to claim 1, wherein said pre-form mould is adapted to remove a portion of the liquid from said pulp slurry by the application of heat and pressure thereby extracting steam from said pulp slurry through a mould pre-form mesh.

9. A method according to claim 8, wherein steam is extracted through said mesh via vents incorporated into an opposing part of the pre-form mould.

10. A method according to claim 1, where the amount of moisture left in differing parts of the pre-form is controlled to allow for a required amount of elasticity in one of the subsequently re-moulded pre-form and secondary moulding stage.

11. A method according to claim 1, where the thickness, density and compaction of pulp in differing parts of the pre-form, is calculated to allow for a determined amount of elasticity and deformation in one of the subsequently remoulded pre-form and secondary moulding stage.

12. A method of forming a moulded and printed product from pulp material comprising the steps of:

forming a pre-form mould to have at least one of the following:
planar surfaces,
compound conjoined planar surfaces and
two dimensional curved surfaces;

transferring an amount of pulp slurry material to said pre-form mould;

forming a moulded pre-form from said transferred pulp slurry material, said moulded pre-form having at least one of the following:
planar surfaces,
compound conjoined planar surfaces and
two dimensional curved surfaces;

applying printing to said at least one of said planar and dimensional curved surfaces of said pre-form in a pre-distorted configuration, wherein said printing is applied as an anamorphic projection to said moulded pre-form; and one of moulding and re-moulding the printed pre-form to a final shape whereby said printed surfaces retain said printing without running and said printing conforms to a desired post distortion configuration.

13. A method of forming a moulded and printed product from pulp material comprising the steps of:

forming a pre-form mould to have at least one of the following:
planar surfaces,
compound conjoined planar surfaces and
two dimensional curved surfaces;

transferring an amount of pulp slurry material to said pre-form mould;

forming a moulded pre-form from said transferred pulp slurry material, said moulded pre-form having at least one of the following:
planar surfaces,
compound conjoined planar surfaces and
two dimensional curved surfaces;

applying printing to said at least one of said planar and dimensional curved surfaces of said pre-form in a pre-distorted configuration; and one of moulding and re-moulding the printed pre-form to a final shape whereby said printed surfaces retain said printing without running and said printing conforms to a desired post distortion configuration, wherein said pre-form mould is adapted to remove a portion of the liquid from said pulp slurry by the application of heat and pressure thereby extracting steam from said pulp slurry through a mould pre-form mesh, wherein steam is extracted through said mesh via vents incorporated into an opposing part of the pre-form mould, and wherein said vents are positioned to avoid print areas of said printed product.

14. A method of forming a moulded and printed product from pulp material comprising the steps of:

forming a pre-form mould to have at least one of the following:
planar surfaces,
compound conjoined planar surfaces and
two dimensional curved surfaces;

transferring an amount of pulp slurry material to said pre-form mould, wherein the step of transferring said pulp slurry is effected by a shaped mesh platen which lifts the slurry as a pulp mat into said pre-form mould;

forming a moulded pre-form from said transferred pulp slurry material, said moulded pre-form having at least one of the following:
planar surfaces,
compound conjoined planar surfaces and
two dimensional curved surfaces;

wherein the step of forming a moulded pre-form includes the step of applying a low heat of about 50° C. and pressure to create said moulded pre-form;

applying printing to said at least one of said planar and dimensional curved surfaces of said pre-form in a pre-distorted configuration, wherein said step of applying printing includes the steps of:

opening the pre-form mould with said moulded pre-form held in situ by suction so as to allow the application of said printing to said moulded pre-form, and applying said printing via a pre-printed heat release inked carrier film;

one of moulding and re-moulding the printed pre-form to a final shape whereby said printed surfaces retain said printing without running and said printing conforms to a desired post distortion configuration, wherein the step of one of moulding and re-moulding said pre-form includes the step of re-moulding by the application of heat of about 175° C. and pressure of about 400 Kpa wherein said heat releases ink to effect transfer to said pre-form; and transferring said printed pre-form, without said carrier film, to a final mould with a differing profile and shape where a final application of heat of about 200° C. alters the shape and substantially extracts any remaining moisture from said moulded and printed product.

* * * * *